United States Patent [19]

Rolston

[11] 4,289,427

[45] Sep. 15, 1981

[54] PROCESS FOR INSTALLING ROOF BOLTS

[75] Inventor: John A. Rolston, Newark, Ohio

[73] Assignee: Owens-Corning Fiberglas Corporation, Toledo, Ohio

[21] Appl. No.: 10,097

[22] Filed: Feb. 7, 1979

[51] Int. Cl.[3] ..... E21D 20/02

[52] U.S. Cl. ..... 405/260; 405/258

[58] Field of Search ..... 405/259, 260, 261, 262, 405/258; 85/63, 61, 74, 75

[56] References Cited

U.S. PATENT DOCUMENTS

| | | | |
|---|---|---|---|
| 1,524,570 | 1/1925 | Rawlings | 85/63 |
| 3,332,244 | 7/1967 | McLean | 405/260 |
| 3,389,561 | 6/1968 | Taylor | 405/260 |
| 3,436,923 | 4/1969 | Lagerstrom | 405/260 |
| 3,698,196 | 10/1972 | Jankowski et al. | 405/261 |
| 3,738,071 | 6/1973 | Finsterwalder | 405/260 X |
| 4,000,623 | 1/1977 | Meardi | 405/260 |
| 4,092,814 | 6/1978 | Kern | 405/260 X |
| 4,160,615 | 7/1979 | Baldwin | 405/259 |

FOREIGN PATENT DOCUMENTS

| | | | |
|---|---|---|---|
| 2151886 | 4/1972 | Fed. Rep. of Germany | 405/259 |

*Primary Examiner*—Dennis L. Taylor

*Attorney, Agent, or Firm*—Ronald C. Hudgens; Philip R. Cloutier; Greg Dziegielewski

[57] ABSTRACT

A process for supporting the roof of a mine shaft includes drilling a hole into the roof and then inserting a multi-stranded cable into the hole. The cable has a duct therein to allow the exit of air during its insertion. During the insertion, the cable is rotated and a bonding agent is introduced into the annulus between it and the surface of the hole.

10 Claims, 4 Drawing Figures

PROCESS FOR INSTALLING ROOF BOLTS

BACKGROUND OF THE INVENTION

The development of mine roof supporting systems has progressed from the use of wooden braces to roof bolting systems with elongate tensioned steel bolts and, more recently, to the grouting of bore holes.

As a seam of coal or ore is removed in the course of mining, the static vertical and horizontal pressures previously exerted by that seam no longer are available to maintain equilibrium within the surrounding strata. As a consequence, there occurs a slight heaving upward of the floor, an inward bulging at the sides and a drooping of the roof of the shaft. This vertical and horizontal displacement of the roof, sidewalls and floor occurs rapidly until a semi-static equilibrium is reached. However, a slow creep often will continue until the floor or a sidewall collapses.

Traditionally, roof bolting has been carried out by drilling a series of holes into a mine wall or roof strata, following which a steel anchor bolt with an expandable anchor on the upper end is inserted into each bore. A bearing plate is mounted on the lower end of the bolt to abut against the roof or wall surface. Next, the bolt is tightened both to lock the upper anchor and to tension the bolt, thus compressing the strata.

Recent theories describing roof collapse assert that a mere compression of the roof strata may not be adequate. The inadequacy stems from the side-slipping within the strata which may totally negate the support supplied by tensioned bolts. Such side-slipping can shift the direction of overburden pressures to negate the supportive effect of tensioned roof bolts. Thus, investigators have proposed that side-slipping of the overburden can be avoided by completely filling each roof bore with a dowel. As a consequence, as the stratum begins to shift, the incipient motion immediately will be opposed by the dowel surface. By comparison, conventional steel roof bolts are much slimmer than the roof bores in which they are inserted and strata slippage is permitted beyond a critical point leading to failure.

In the average underground coal mine, the seam of coal being excavated is about thirty inches in height. Thus, machines and apparatus used within such mines must be designed to operate under ceilings of that height. Accordingly, the current practice for inserting roof bolts is to flex the steel bolt through an angle of about 90° before it is inserted within a roof bore. Generally, a thirty inch length of the bolt initially is inserted; then the bolt is straightened to the extent possible; the straightened part is inserted next; and this sequence continues until the bolt is completely inserted and the bearing plate and bolt head are in operable position.

SUMMARY OF THE INVENTION

This invention comprises a process for supporting the roof and sidewalls of a mine shaft wherein a length of cable comprising resin bonded glass strands is rotatively inserted into a roof bore simultaneously with a grout or bonding agent. Cable rotation during insertion improves the grouting procedure in three ways. Rotation mixes the grout, wipes the grout against the surface of the bore, and carries the grout to the top of the bore hole. Rotation in a direction to tighten the cable strands tends to push the grout upward due to the natural flow of liquids in the direction of least resistance. For purposes of this invention, suitable grouts are sulfur and polyester, epoxy, polyurethane resins and the like.

An air passage is provided in the cable to allow the escape of entrapped air as the cable advances into the bore hole. Such passages may be provided as one or more hollow filaments or as a passageway formed between the glass strands.

Objects and advantages of this invention will hereinafter become evident from the following description of the preferred embodiments.

DESCRIPTION OF THE PREFERRED EMBODIMENTS

Figure 1:
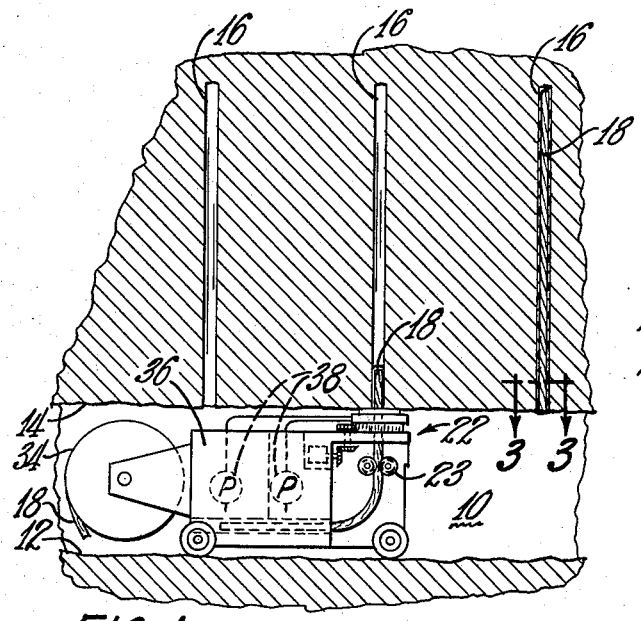
FIG. 1 is a sectional elevational view showing a mine shaft with roof bolt holes extending into the roof and apparatus for inserting roof bolts into the holes.

Referring to FIG. 1, a typical mine shaft 10 includes a floor 12 and a roof 14. Holes 16 are drilled in the roof, the holes having a length of from about 4 to about 12 feet. A cable 18 which includes a plurality of fiberglass strands 20 (FIG. 3) is inserted into the hole 16 by a drive mechanism 22 which includes feed rollers 23. The drawing shows four strands formed of a plurality of resin bonded glass fibers or filaments, but is illustrative only. Cable formed of from three to eight such strands is satisfactory, depending upon acceptable flexibility for operation.

As the cable is being inserted into the hole, the upward push by the drive mechanism 22 is resisted by the frictional back pressure of the surface of the hole 16. Thus, the cable is in slight compression, particularly near the entrance of the hole. Therefore, the cable requires a certain amount of rigidity because the strands must be pushed to near the top of the hole. Rotation of the cable in a direction in which the strands are twisted renders the cable more rigid and thereby makes its insertion into the hole easier. Additionally, outcroppings of rough rock surface within the hole can catch on the top surface of the cable as it is inserted and cause it to buckle or bend. However, with rotation during insertion, the twisting motion of the cable causes it to pass the outcropping and continue its upward movement.

Figure 3:
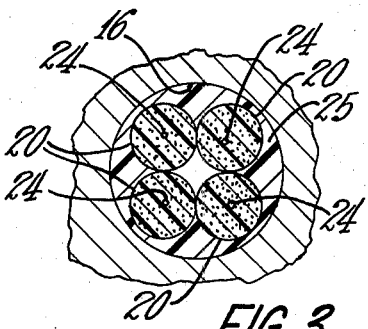
FIG. 3 is a sectional view through an inserted and bonded roof bolt taken along lines 3—3 of FIG. 1.

FIG. 3 shows a hollow filament or open duct 24 located in each of the four strands 20. Each such duct extends from one end of the cable to the other to allow air to escape as the cable is inserted.

Simultaneously with the insertion of the cable, a bonding agent 25 is introduced into the annulus shaped cavity defined between surface 16 and cable 18. The bonding agent, which will be described in more detail, is introduced through a plurality of passages 26 in face plate 27. Face plate 27 presses against a sealing gasket 28 positioned against the roof 14 to prevent leakage of the bonding agent.

Beneath face plate 27 is a rotating plate or cable rotor 30 having a patterned opening 32, the profile of which corresponds to the shape of the cable. Thus, plate 30 grips cable 18 as it is inserted and rotates it in the direction of the twist of the strands. The resultant twisting action of the cable serves to urge the bonding agent upwardly into the hole, thus minimizing the pump pressure otherwise necessary to inject the bonding agent, preferably not substantially greater than 15–20 p.s.i. Also, because strands 20 are moving upwardly and rotating, the bonding agent, having a viscosity, preferably of about 100–2,000 c.p.s., clings to and intimately adheres to the strands while being wiped against the surface of hole 16.

Figure 2:
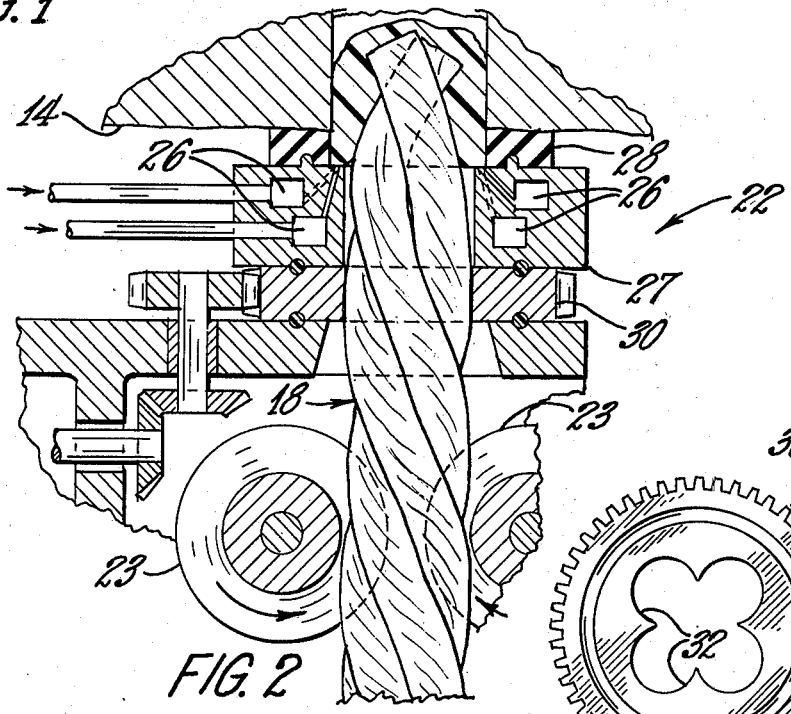
FIG. 2 is a sectional view of apparatus for inserting a roof bolt and the liquid bonding agent with the apparatus being mounted at the entrance of the bolt hole.
Figure 4:
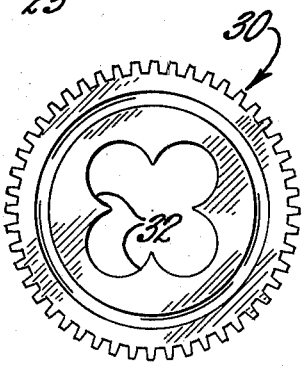
FIG. 4 is a plan view of the cable rotor shown in FIG. 2.

The periphery of rotor 30 is formed having gear teeth which are meshed with the associated gears of a drive train shown in FIG. 2. This arrangement represents one of several ways by which rotor 30 can be driven.

For purposes of illustration only, cable 18 is shown mounted on reel 34 from which lengths thereof may be removed as needed.

Bonding agent 25 is injected from a reservoir 36 by one or more pumps 38. The number of such pumps and the exact structure of the storage container 36 depend on the kind of bonding agent used. Suitable bonding agents include sulfur and one or more resins selected from the group consisting of polyester, epoxy and polyurethane resins and the like.

Unsaturated polyester resins having workable viscosities (100–2,000 c.p.s.) at mine temperatures (about 55° F.) represent a preferred bonding agent. From the standpoint of cost economy, water resistance and desirable physical properties, a highly unsaturated maleic orthophthalic/propylene glycol polyester resin is preferred. The curing agent provided with the polyester resin should cause curing in about one minute under mine conditions. A number of such agents are known in the art, one example being benzoyl peroxide/diethyl aniline.

An example of an appropriate epoxy resin for mine bolt grouting is diglycidyl ether of bisphenol A. Suitable curing agents for use therewith are aliphatic polyamines, polyamides and their adducts. The epoxy resins generally have a higher viscosity than the polyester resins and in this sense may be slightly less desirable.

Thermosetting polyurethanes offer several properties well suited for the presently contemplated use. For example, these properties include higher cured strength, rapid rates of curing and potential for chemical bonding with both the cable and the surface of the drilled hole. Two-component urethanes can be formulated for a wide variety of performance parameters including hardness, tensile strength and speed of cure.

Sulfur is another suitable liquid bonding agent. The temperature at which it is inserted into the roof bore must be such that it will not solidify prematurely. It is believed that a temperature of about 135° C. represents an average temperature appropriate for the agent at the position of injection. This temperature is slightly above the melting point of sulfur.

Having described the preferred embodiments, it will be clear to those having ordinary skill in the art that various modifications can be made without departing from the spirit of the invention. Accordingly, it is not intended that the language used to describe the invention herein be in any way limiting. Rather, it is intended that the invention be limited only by the scope of the appended claims.

What is claimed is:

1. A process comprising:

inserting a cable into a hole in a surface of a mine shaft, said cable comprising a plurality of twisted strands wherein a plurality of said strands each have a duct extending from one end of the strand to the other to permit air to escape from the hole;

sealing the entrance of said hole around said cable;

rotating the cable in the direction to tighten the cable during its insertion into said hole and;

simultaneously with the insertion of said cable, injecting a bonding agent into said hole around said cable.

2. The process of claim 1 wherein the strands comprise resin bonded glass fibers.

3. The process of claim 2 wherein the bonding agent is selected from the group consisting of polyesters, epoxy and polyurethane resins and sulfur.

4. The process of claim 3 wherein the bonding agent is sulfur and prior to its insertion it is heated to a temperature sufficient to maintain it above its melting point until the cable is inserted to the desired depth.

5. The process of claim 3 wherein the viscosity of the bonding agent is in the range 100–2,000 c.p.s. at 55° F.

6. The process of claim 3 wherein the bonding agent is introduced into said hole at a pressure not substantially greater than 15–20 p.s.i.

7. The process of claim 6 wherein the viscosity of the bonding agent is in the range 100–2,000 c.p.s. at 55° F.

8. The process of claim 1 wherein the bonding agent is introduced into said hole at a pressure not substantially greater than 15–20 p.s.i.

9. The process of claim 8 wherein the viscosity of the bonding agent is in the range 100–2,000 c.p.s. at 55° F.

10. A mine shaft having its roof and sides supported by glass fibers inserted into said roof or sides by the process of claim 1.

* * * * *